US007156682B1

(12) United States Patent
Lai

(10) Patent No.: US 7,156,682 B1
(45) Date of Patent: Jan. 2, 2007

(54) ELECTRIC SOCKET

(76) Inventor: Li-Chun Lai, 21F-1, No. 33, Sec. 1, Minsheng Rd., Panciao City, Taipei County (TW)

( * ) Notice: Subject to any disclaimer, the term of this patent is extended or adjusted under 35 U.S.C. 154(b) by 0 days.

(21) Appl. No.: 11/211,447

(22) Filed: Aug. 26, 2005

(51) Int. Cl.
*H01R 13/625* (2006.01)

(52) U.S. Cl. ..... 439/346; 439/348; 439/270

(58) Field of Classification Search ..... 439/346, 439/345, 535–536, 263, 133–136, 142–145, 439/140, 268, 347–348, 270; 174/66–67; 220/3.8, 242
See application file for complete search history.

(56) References Cited

U.S. PATENT DOCUMENTS 5,893,772 A * 4/1999 Carmo et al. ..... 439/346
5,997,319 A * 12/1999 Wu ..... 439/143
6,193,539 B1 * 2/2001 Chang ..... 439/346
6,220,885 B1 * 4/2001 Lemberger et al. ..... 439/346
6,786,753 B1 * 9/2004 Lai ..... 439/346
6,805,572 B1 * 10/2004 Lai ..... 439/348
6,896,537 B1 * 5/2005 Burton ..... 439/346
6,984,139 B1 * 1/2006 Lai ..... 439/142

* cited by examiner

*Primary Examiner*—Truc T. Nguyen
*Assistant Examiner*—Edwin A. Leon

(57) ABSTRACT

An electric socket includes a rotation unit and a switching cap unit. The rotation unit abuts the conducting units inside the socket. The switching cap unit protrudes from the rest of the socket. The rotation unit may be moved along with the switching cap unit. When each of the two prongs of a plug is inserted into the two prong slots of the socket, a user may rotate switching cap unit by a certain angle so that the long sides of the rotation unit may press against the two conducting units of the socket; now, the two conducting units of the socket seize and lock the two prongs of the plug. To take out the plug, a user may rotate the switching cap unit in the reversed direction by a certain angle; now, the two long sides of the rotation unit no longer press against the two conducting units, and the plug may be taken out from the two slots.

20 Claims, 8 Drawing Sheets

ELECTRIC SOCKET

BACKGROUND OF THE INVENTION

1. Field of the Invention

The invention generally relates to an electric socket. More particularly, the invention relates to an improved electric socket where a plug may be locked in the socket.

2. Description of the Prior Art

As of now, electric sockets are widely used; people only have to insert the plug of an electric device into a socket to draw AC from the socket into the device. Sockets of the prior art do not have a plug locking design and a plug may be disengaged from such socket when the plug is accidentally pulled; hence, this will stop the operation of the corresponding electric device and may cause the two copper prongs of the plug to bend or deform; such bending and deformation may in turn cause poor electric contact, excessive heat and even fire. Hence, there is a need for a socket where secured electric connection may be ensured and a plug may be locked in the socket.

Whence, sockets of the prior art have many disadvantages and need to be improved.

To eliminate the disadvantages of the prior art, the inventor has put in many years of effort in the subject and has come up with the improved electric socket of the present invention.

SUMMARY OF THE INVENTION

The present invention is to provide an improved electric socket where an oval-shaped rotation unit may press against the two prongs of a plug so as to lock the plug inside the socket.

Another, the present invention is to provide an improved electric socket where a switching cap unit is employed to switch between a locked position and an unlocked position.

Still another, the present invention is to provide an improved electric socket where a locking member is provided on each of the two conducting units inside the socket so that each locking member may engage with the hole of the corresponding prong and the plug may be locked inside the socket when the two conducting units are pressed against by the rotation unit.

Still another, the present invention is to provide an improved electric socket where an arc-shaped portion or a circular portion or a protruding portion is provided on each of the conducting units and a locking member is provided on each of the two long sides of the rotation unit so that each locking member may engage with the hole on the corresponding prong when the rotation unit presses against the two conducting units and so that the plug will be locked inside the socket.

Accrodingly, the improved electric socket of the present invention comprises a base, two conducting units, a rotation unit, a covering unit, a positioning ring and a switching cap unit. A space is provided inside the base. Two passages are provided in the space; an opening is provided on the front end of each of the passages. A positioning slot is provided on the rear end of each of the passages. A shaft is provided in the space. A stopper is disposed by the shaft. Each conducting unit is fitted in the corresponding passage. Each of the two rear end members is fitted in the corresponding positioning slot. The rotation unit has two long sides and two short sides; an elongated hole is centrally provided in the rotation unit; a positioning member is provided on the top of the rotation unit; the elongated hole of the rotation unit may engage with the shaft of the base so as to allow the rotation unit to rotate inside the base.

The covering unit has a top plate and a wall which is perpendicular to the top plate. An opening is provided on the top plate. Two slots are provided on the wall of the covering unit. The top plate of the covering unit seal may close the top portion the base. The positioning member of the rotation unit may extend beyond the hole of the positioning ring. The wall of the covering unit may close the front side the base so that the two slots may be lined up with the two conducting units. The positioning ring has a step-down portion. A hole is provided at the center of the step-down portion; the positioning ring may be fitted in the opening of the covering unit; the positioning member of the rotation unit may extend beyond the hole of the positioning ring. The switching cap unit has a grip portion and a protruding circular portion. A positioning hole is centrally provided in the protruding circular portion. The protruding circular portion of the switching cap unit may engage with the step-down portion of the positioning ring, and the positioning hole of the switching cap unit may engage with the positioning member of the rotation unit so as to allow the rotation unit to move with the switching cap unit. After the two prongs of a plug are inserted into the base through the two slots and reach the two conducting units, current may flow from the two conducting units to the plug. To lock the plug, a user may rotate the grip portion of the switching cap unit by a certain angle so that each long side of the rotation unit presses against the corresponding conducting unit, which in turn may seize and lock the corresponding prong of the plug. To take out the plug, a user may rotate the grip portion of the switching cap unit in the reversed direction by a certain angle. Now, the two long sides of the rotation unit no longer press against the conducting units, and the plug may be taken out from the two slots.

These features and advantages of the present invention will be fully understood and appreciated from the following detailed description of the accompanying drawings.

DETAILED DESCRIPTION OF THE PREFERRED EMBODIMENT

Figure 1:
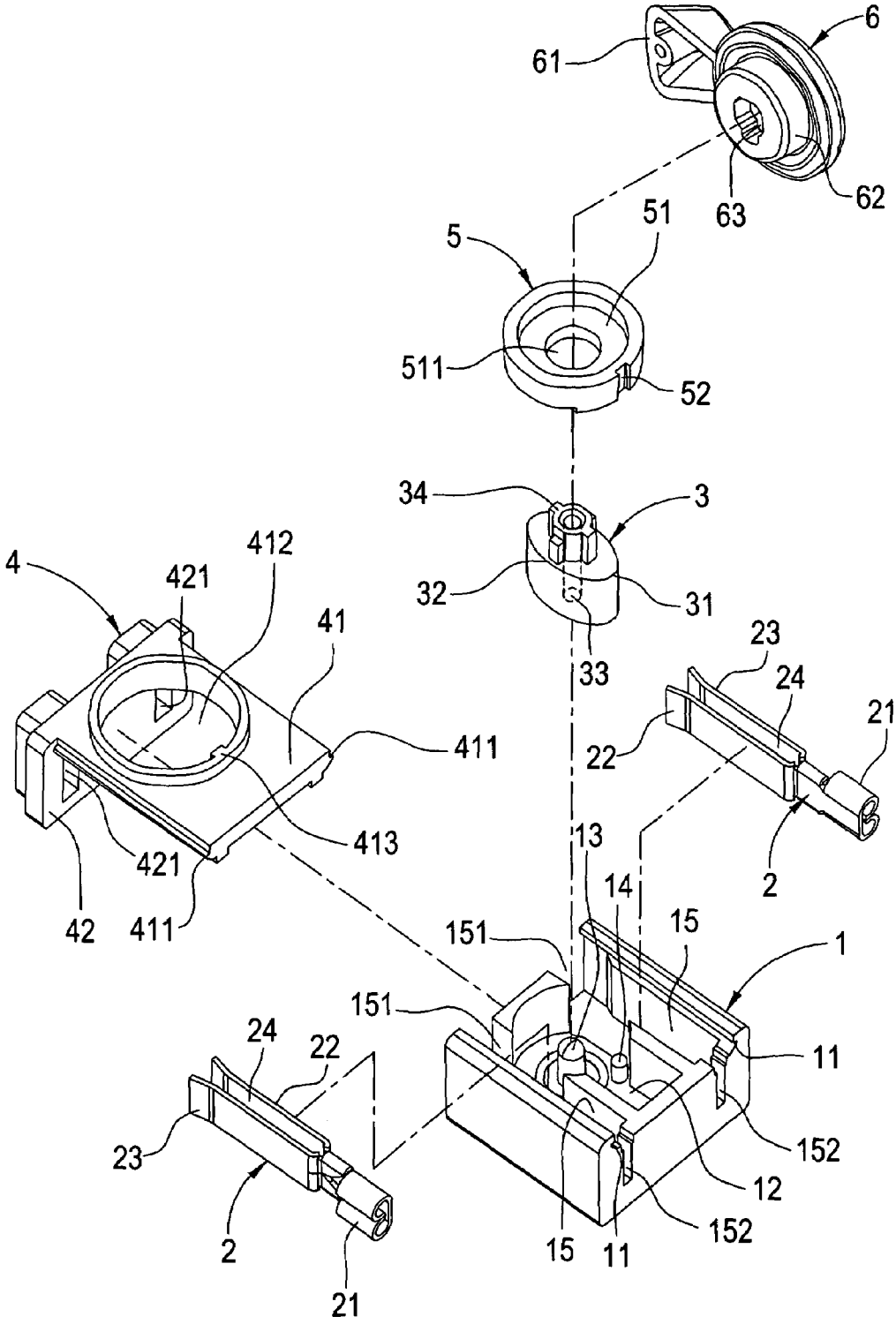
FIG. 1 is an exploded view of the improved electric socket of the present invention.
Figure 2:
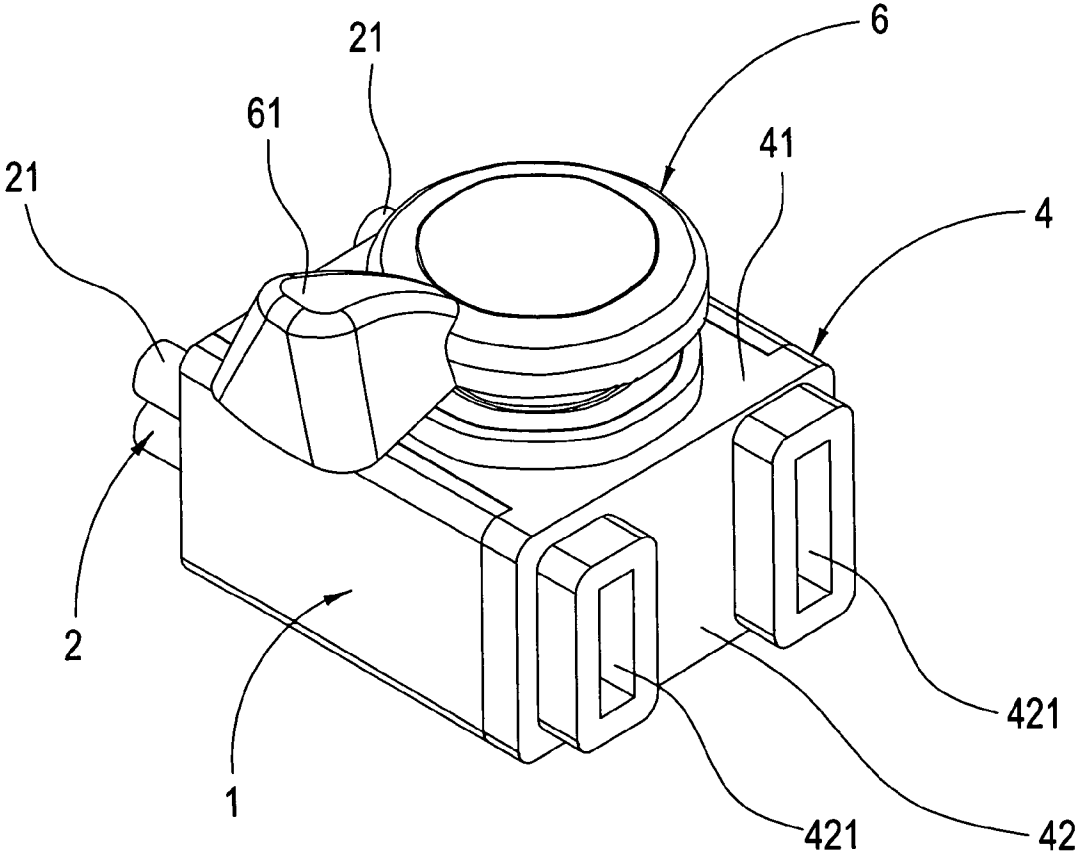
FIG. 2 is a perspective view of the improved electric socket of the present invention.

Referring to FIGS. 1 and 2, the improved electric socket of the present invention comprises a base 1, two conducting units 2, a rotation unit 3, a covering unit 4, a positioning ring 5 and a switching cap unit 6.

The base 1 has two side walls. A groove 11 is provided on each of the side walls. A space 12 is provided inside the base 1. A shaft 13 is provided in the space 12. A stopper 14 is disposed by the shaft 13 and is spaced apart from the shaft 13. A passage 15 is provided on either side of the shaft 13. An opening 151 is provided on the front end of each of the passages 15, and a positioning slot 152 is provided on the rear end of each of the passages 15.

Each conducting unit 2 has a rear end member 21 and a pair of plates 22, 23; each rear end member 21 is disposed at the rear end of the unit 2, and the two plates 22, 23 are parallel to each other. A prong slot 24 is formed between each pair of plates 22, 23. Each conducting unit 2 is fitted in the corresponding passage 15. Each rear end member 21 is fitted in the positioning slot 152 and extends beyond the slot 152.

The rotation unit 3 is substantially oval and has two long sides 31 and two short sides 32. An elongated hole 33 is provided at the center of the rotation unit 3, and a positioning member 34 is provided on the top of the rotation unit 3. The elongated hole 33 may engage with the shaft 13 of the base 1 so that the rotation unit 3 may be rotated. In addition, when the rotation unit 3 is rotated, the rotation angle of the rotation unit 3 will be limited by the stopper 14.

The covering unit 4 has a top plate 41 and a wall 42; the plate 41 is perpendicular to the wall 42. A track 411 is provided on each of the two sides of the top plate 41. An opening 412 is provided on the covering unit 4. An engagement member 413 extends from the edge of the opening 412. Two slots 421 are provided on the wall 42. The engagement between the two tracks 411 of the covering unit 4 and the two grooves 11 of the base 1 allows the top plate 41 of the covering unit 4 to close the top open portion of the base 1 and allows the positioning member 34 of the rotation unit 3 to extend beyond the opening 412 of the top plate 41. Also, the wall 42 of the covering unit 4 may close the front portion of the base 1. Hence, the two slots 421 may be lined up with the two prong slots 24.

The positioning ring 5 has a step-down portion 51. A hole 511 is provided at the center of the step-down portion 51. An engagement notch 52 is provided on the circumference of the positioning ring 5. After the engagement notch 52 engages with the engagement member 413 of the covering unit 4, the positioning ring 5 is fitted in the opening 412 of the covering unit 4; now, the positioning ring 5 can not be moved circumferentially, and the positioning member 34 of the rotation unit 3 may extend beyond the hole 511 of the positioning ring 5.

The switching cap unit 6 has a grip portion 61 and a protruding circular portion 62. A positioning hole 63 is centrally provided in the protruding circular portion 62. In use, the protruding circular portion 62 of the switching cap unit 6 may engage with the step-down portion 51 of the positioning ring 5, and the positioning hole 63 of the switching cap unit 6 may engage with the positioning member 34 of the rotation unit 3 so as to allow the rotation unit 3 to move with the switching cap unit 6.

Figure 3A:
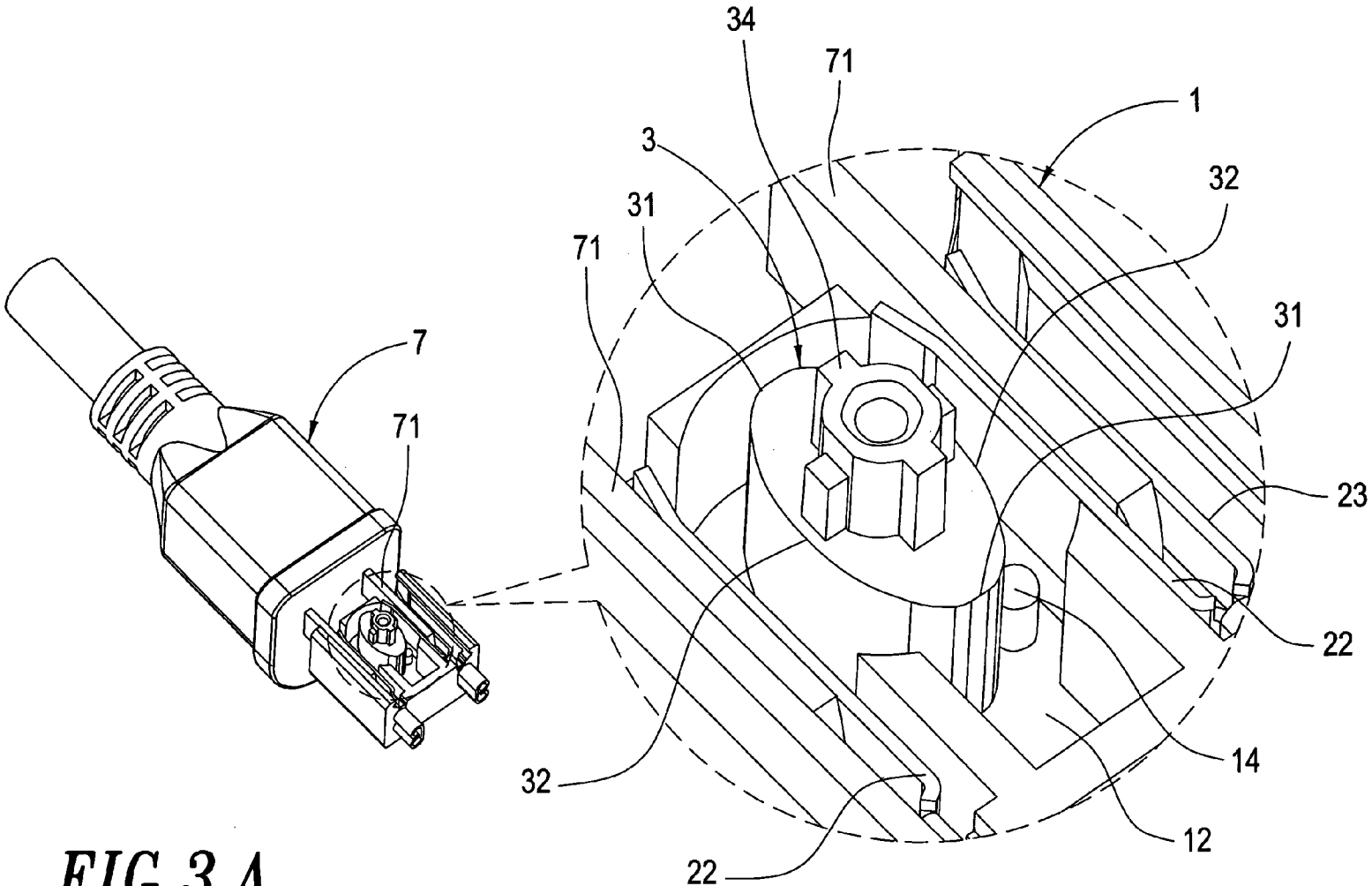
FIGS. 3A and 3B are perspective views illustrating how the first embodiment of the present invention is used.
Figure 3B:
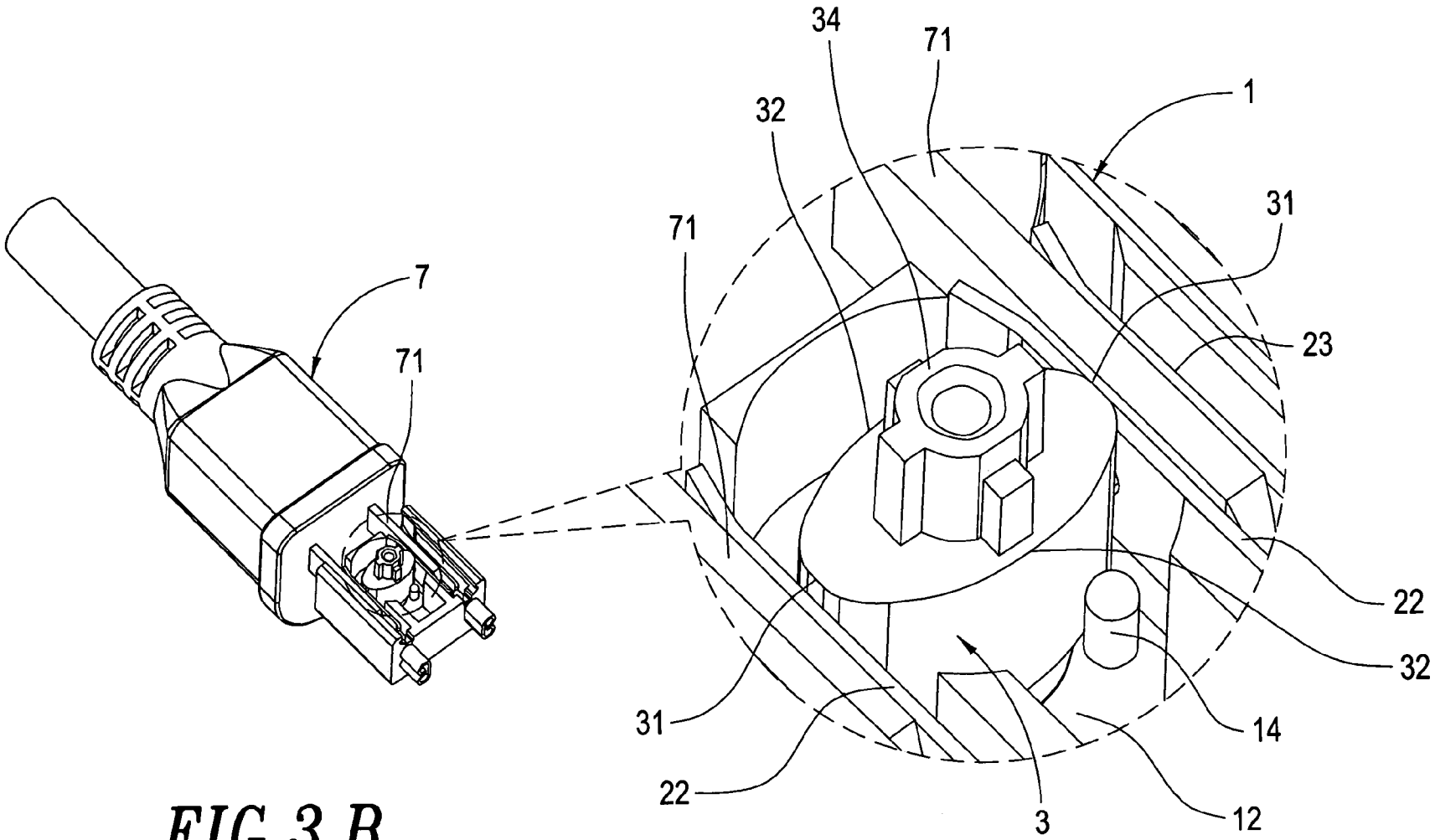

FIGS. 3 and 4 illustrate how the socket of the present invention is used. When the socket is in an unlocked position, each short side 32 of the rotation unit 3 abuts the corresponding conducting unit 2. The two prongs 71 of a plug 7 may be inserted into the base 1 through the two slots 421 and reach the two prong slots 24. Hence, current may flow from the two conducting units 2 to the plug 7.

To lock the plug, a user may rotate the grip portion 61 of the switching cap unit 6 by a certain angle so that each long side 31 of the rotation unit 3 presses against the corresponding plate 22 and the two pairs of plates 22, 23 seize and lock the two prongs 71 of a plug 7 therein. To take out the plug, a user may rotate the grip portion 61 of the switching cap unit 6 in the reversed direction by a certain angle; now, the two long sides 31 of the rotation unit 3 no longer press against the two pairs of plates 22, 23, and the plug 7 may be taken out from the two slots 421.

Figure 4A:
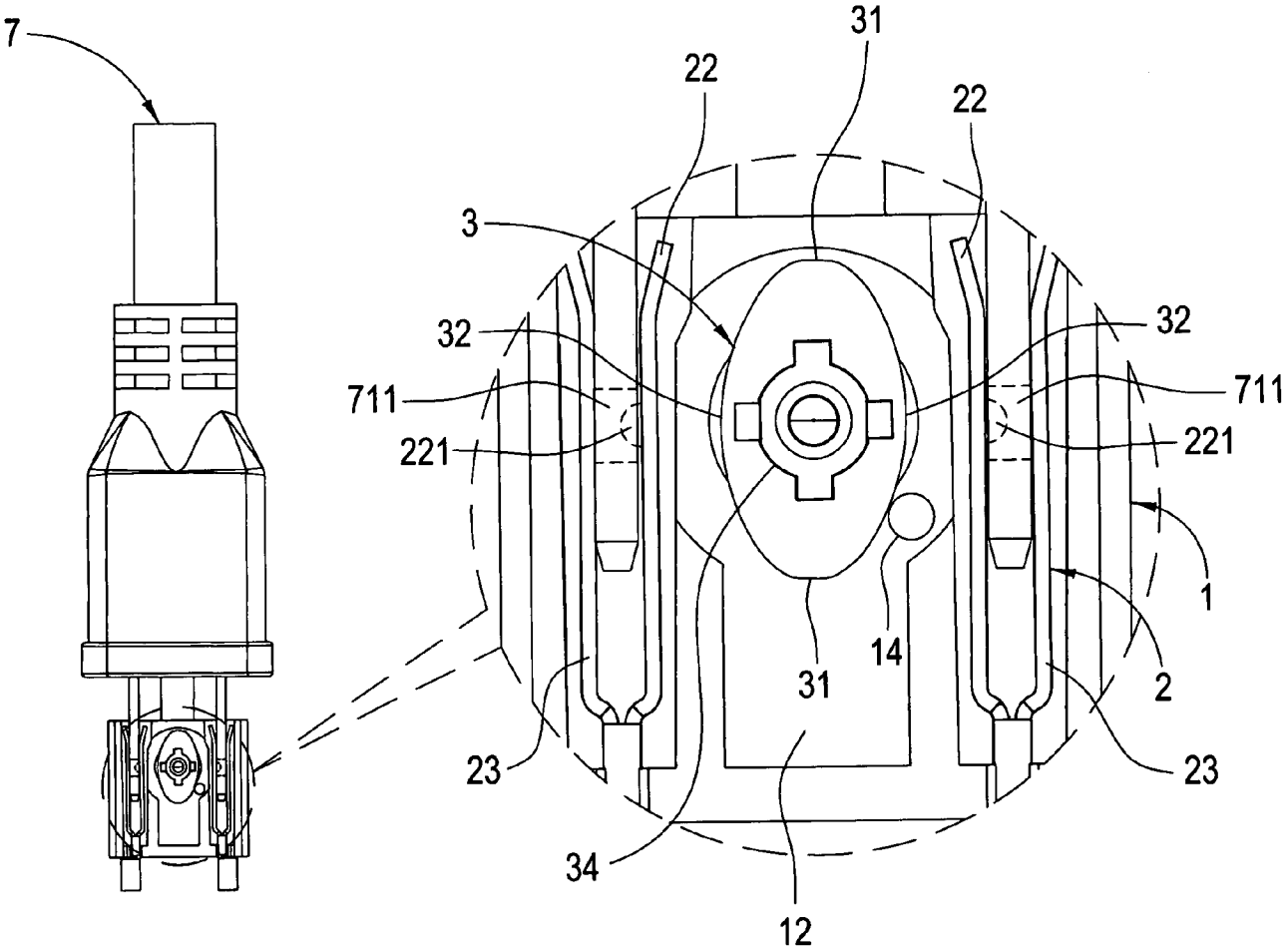
FIGS. 4A, 4B and 4C are perspective views illustrating how the second embodiment of the present invention is used.
Figure 4C:
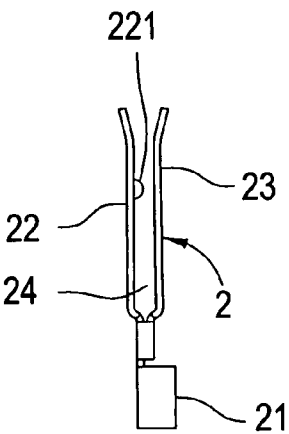
Figure 4B:
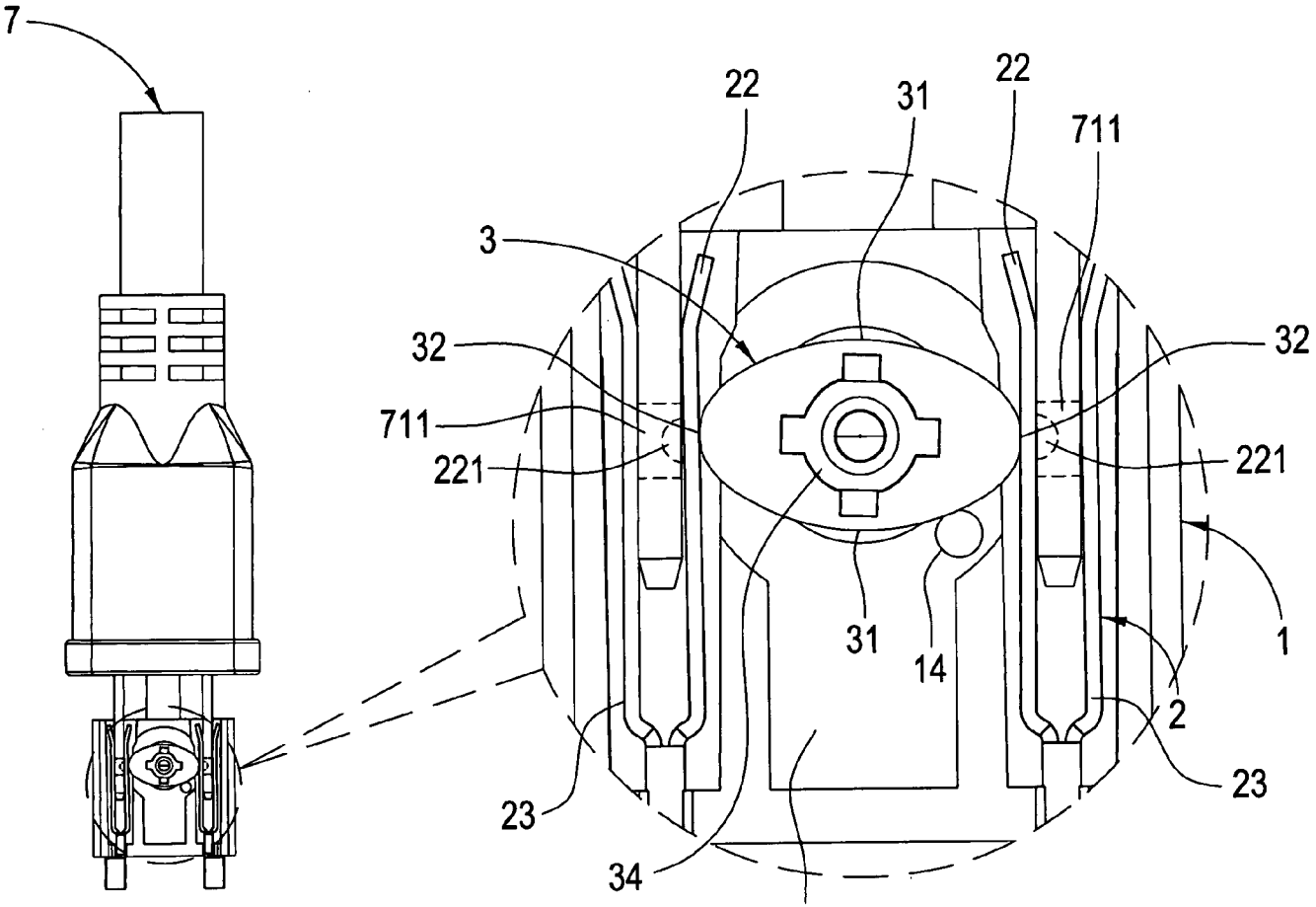

FIGS. 4A, 4B and 4C illustrate how a second embodiment of the present invention is used. The second embodiment is similar to the first embodiment shown in FIGS. 1 and 2 in terms of overall structure and the method of operation; however, in the second embodiment, a locking member 221 is provided on the inner side of each of the two inner plates 22 of the two conducting units 2. In use, when the two prongs 71 of the plug 7 are inserted into the two prong slots 24 of the two conducting units 2, each locking member 221 may engage with the corresponding hole 711 on the prong 71. Hence, when each long side 31 of the rotation unit 3 presses against the corresponding plate 22, the plug 7 will be locked in the socket. To take out the plug, a user may rotate the grip portion 61 of the switching cap unit 6 in the reversed direction by a certain angle; now, the two long sides 31 of the rotation unit 3 no longer press against the two inner plates 22, and the plug 7 may be taken out from the socket.

Figure 5A:
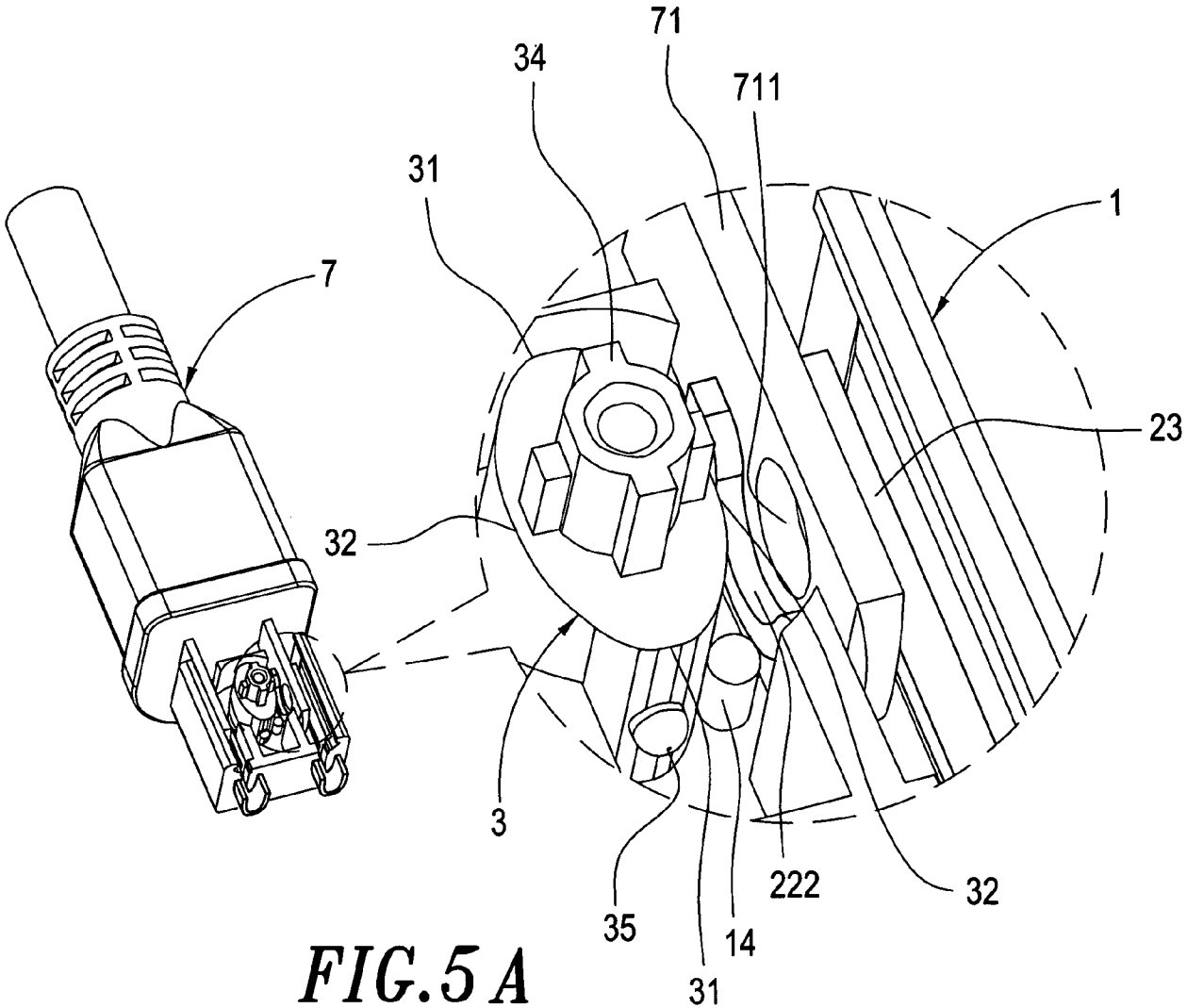
FIGS. 5A, 5B and 5C are perspective views illustrating how the third embodiment of the present invention is used.
Figure 5C:
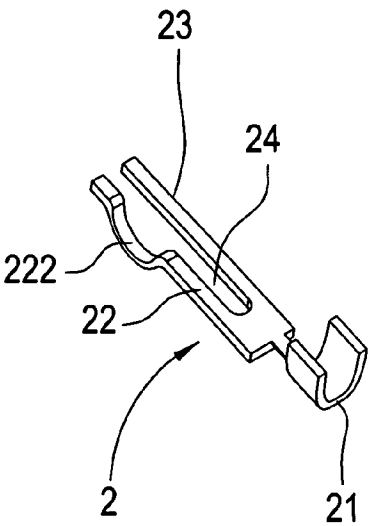
Figure 5B:
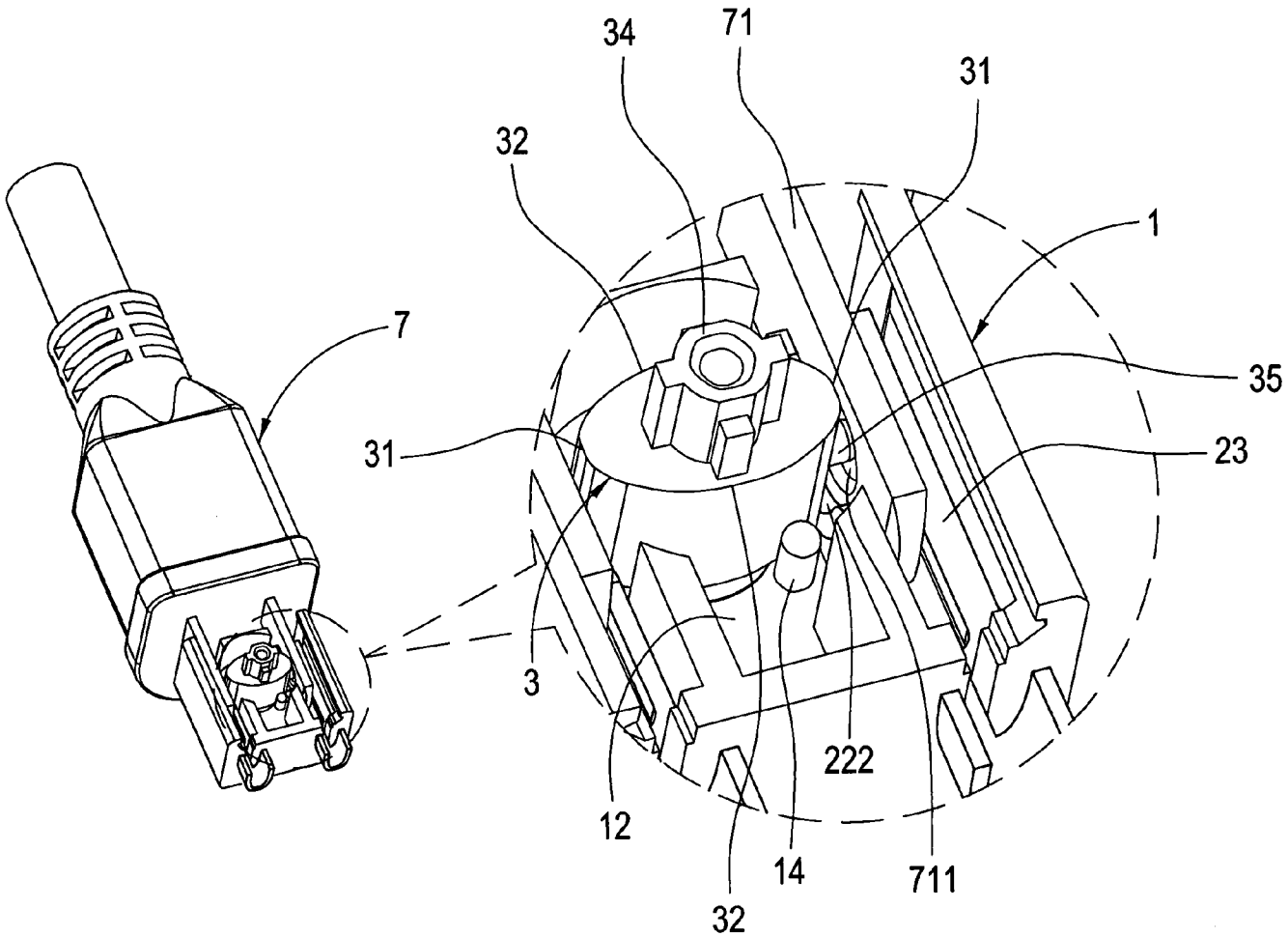

FIGS. 5A, 5B and 5C illustrate how a third embodiment of the present invention is used. The third embodiment is similar to the first embodiment shown in FIGS. 1 and 2 in terms of overall structure and the method of operation; however, in the third embodiment, an arc-shaped portion 222 or a circular portion or a protruding portion is provided on the front part of each inner plate 22, and a locking member 35 is provided on each of the long sides 31 of the rotation unit 3.

In use, when the two prongs 71 of the plug 7 are inserted into the two prong slots 24 of the two conducting units 2, each arc-shaped portion 222 will abut the hole 711 of the corresponding prong 71 and each locking member 35 will engage with the corresponding hole 711 through the corresponding arc-shaped portion 222 so that the plug 7 will be locked in the socket. To take out the plug, a user may rotate the grip portion 61 of the switching cap unit 6 in the reversed direction by a certain angle; now, the each locking member 35 no longer engages with the corresponding hole 711, and the plug 7 may be taken out from the socket.

In contrast to the similar devices of the prior art, the socket of the present invention has the following advantages:

1. A rotation unit in an oval shape is used to press against the two conducting units of the socket so as to seize the two prongs of the plug and lock the plug inside the socket.
2. A switching cap unit is used to switch between a locked position and an unlocked position.
3. A locking member is provided on each of the two inner plates of the two conducting units so that each locking member may engage with the corresponding hole on the prong when the rotation unit presses against the two conducting units and so that the plug will be locked inside the socket.
4. An arc-shaped portion or a circular portion or a protruding portion is provided on each of the inner plates and a locking member is provided on each of the long sides of the rotation unit so that each locking member may engage with the hole on the corresponding prong when the rotation unit presses against the two conducting units and so that the plug will be locked inside the socket.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An electric socket, comprising:

a base, a space being provided inside the base, a shaft being provided in the space, a passage being provided on either side of the shaft, a conducting unit being fitted in each passage, the rear end of each conducting unit extending beyond the rear side of the base, each conducting unit having a pair of plates that are parallel to each other, each pair of plates forming a prong slot therebetween;

a rotation unit, the rotation unit having two long sides and two short sides, a hole being provided at the center of the rotation unit, a positioning member being provided on the top of the rotation unit, the hole of the rotation unit engaging with the shaft of the base so as to allow the rotation unit to rotate inside the base;

a covering unit, the covering unit having a top plate and a wall which is perpendicular to the top plate, an opening being provided on the covering unit, a positioning ring being fitted in the opening, a hole being provided on the positioning ring, two slots being provided on the wall of the covering unit, the top plate of the covering unit closing the top portion the base, the positioning member of the rotation unit extending beyond the hole of the positioning ring, the wall of the covering unit closing the front side of the base, the two slots being lined up with the two prong slots; and a switching cap unit, the switching cap unit having a grip portion, a positioning hole being provided on the underside of the switching cap unit, the positioning hole of the switching cap unit being firmly connected with the positioning member of the rotation unit to allow the rotation unit to move with the switching cap unit.

2. The improved electric socket as in claim 1, wherein a groove provided on each of the side walls of the base may engage with the corresponding track provided on each of the two sides of the top plate so as to close the top portion of the base.

3. The improved electric socket as in claim 1, wherein a stopper is disposed by the shaft to limit the motion range of the rotation unit.

4. The improved electric socket as in claim 1, wherein an opening is provided on the front end of each of the passages of the base, and a positioning slot is provided on the rear end of each of the passages of the base so as to position the two conducting units.

5. The improved electric socket as in claim 1, wherein an engagement member extends from the edge of the opening of the covering unit, and an engagement notch is provided on the circumference of the positioning ring so that the engagement member of the covering unit may engage with the engagement notch of the positioning ring to connect the positioning ring with the covering unit and so that the positioning ring can not move with respect to the covering unit.

6. The improved electric socket as in claim 1, wherein a step-down portion is provided on the positioning ring, and a protruding circular portion is provided on the switching cap unit so that the step-down portion the positioning ring may engage with the protruding circular portion of the switching cap unit to position the rotation unit.

7. An electric socket, comprising:

a base, a space being provided inside the base, a shaft being provided in the space, a passage being provided on either side of the shaft, a conducting unit being fitted in each passage, the rear end of each conducting unit extending beyond the rear side of the base, each conducting unit having a pair of plates that are parallel to each other, each pair of plates forming a prong slot therebetween, a locking member being provided on each of the two inner plates;

a rotation unit, the rotation unit having two long sides and short sides, an elongated hole being provided at the center of the rotation unit, a positioning member being provided on the top of the rotation unit, the elongated hole of the rotation unit engaging with the shaft of the base so as to allow the rotation unit to rotate inside the base;

a covering unit, the covering unit having a top plate and a wall which is perpendicular to the top plate, an opening being provided on the covering unit, a positioning ring being fitted in the opening, a hole being provided on the positioning ring, two slots being provided on the wall of the covering unit, the top plate of the covering unit closing the top portion the base, the positioning member of the rotation unit extending beyond the hole of the positioning ring, the wall of the covering unit closing the front side of the base, the two slots may be lined up with the two prong slots; and a switching cap unit, the switching cap unit having a grip portion, a positioning hole being provided on the underside of the switching cap unit, the positioning hole of the switching cap unit being firmly connected with the positioning member of the rotation unit so that the rotation unit may move with the switching cap unit.

8. The improved electric socket as in claim 7, wherein a groove provided on each of the side walls of the base may engage with the corresponding track provided on each of the two sides of the top plate so as to close the top portion of the base.

9. The improved electric socket as in claim 7, wherein a stopper is disposed by the shaft to limit the motion range of the rotation unit.

10. The improved electric socket as in claim 7, wherein an opening is provided on the front end of each of the passages of the base, and a positioning slot is provided on the rear end of each of the passages of the base so as to position the two conducting units.

11. The improved electric socket as in claim 7, wherein an engagement member extends from the edge of the opening of the covering unit, and an engagement notch is provided on the circumference of the positioning ring so that the engagement member of the covering unit may engage with the engagement notch of the positioning ring to connect the positioning ring with the covering unit and so that the positioning ring can not move with respect to the covering unit.

12. The improved electric socket as in claim 7, wherein a step-down portion is provided on the positioning ring, and a protruding circular portion is provided on the switching cap unit so that the step-down portion the positioning ring may engage with the protruding circular portion of the switching cap unit to position the rotation unit.

13. An electric socket, comprising:

a base, a space being provided inside the base, a shaft being provided in the space, a passage being provided on either side of the shaft, a conducting unit being fitted in each passage, the rear end of each conducting unit extending beyond the rear side of the base, each conducting unit having a pair of plates that are parallel to each other, each pair of plates forming a prong slot therebetween, an arc-shaped portion is provided on each of the inner plates of the conducting units;

a rotation unit, the rotation unit having two long sides and two short sides, a locking member being provided on each of the long side of the rotation unit, a hole being provided at the center of the rotation unit, a positioning member being provided on the top of the rotation unit, the hole of the rotation unit engaging with the shaft of the base so as to allow the rotation unit to rotate inside the base;

a covering unit, the covering unit having a top plate and a wall which is perpendicular to the top plate, an opening being provided on the covering unit, a positioning ring being fitted in the opening, a hole being provided on the positioning ring, two slots being provided on the wall of the covering unit, the top plate of the covering unit closing the top portion the base, the positioning member of the rotation unit extending beyond the hole of the positioning ring, the wall of the covering unit closing the front side of the base, the two slots may be lined up with the two prong slots; and a switching cap unit, the switching cap unit having a grip portion, a positioning hole being provided on the underside of the switching cap unit, the positioning hole of the switching cap unit being firmly connected with the positioning member of the rotation unit so that the rotation unit may move with the switching cap unit.

14. The improved electric socket as in claim 13, wherein a groove provided on each of the side walls of the base may engage with the corresponding track provided on each of the two sides of the top plate so as to close the top portion of the base.

15. The improved electric socket as in claim 13, wherein a stopper is disposed by the shaft to limit the motion range of the rotation unit.

16. The improved electric socket as in claim 13, wherein an opening is provided on the front end of each of the passages of the base, and a positioning slot is provided on the rear end of each of the passages of the base so as to position the two conducting units.

17. The improved electric socket as in claim 13, wherein an engagement member extends from the edge of the opening of the covering unit, and an engagement notch is provided on the circumference of the positioning ring so that the engagement member of the covering unit may engage with the engagement notch of the positioning ring to connect the positioning ring with the covering unit and so that the positioning ring can not move with respect to the covering unit.

18. The improved electric socket as in claim 13, wherein a step-down portion is provided on the positioning ring, and a protruding circular portion is provided on the switching cap unit so that the step-down portion the positioning ring may engage with the protruding circular portion of the switching cap unit to position the rotation unit.

19. The improved electric socket as in claim 13, wherein a circular portion (instead of an arc-shaped portion) is provided on each of the inner plates of the conducting units.

20. The improved electric socket as in claim 13, wherein a protruding portion (instead of an arc-shaped portion or a circular portion) is provided on each of the inner plates of the conducting units.

* * * * *